US008498179B2

(12) United States Patent
Montet et al.

(10) Patent No.: US 8,498,179 B2
(45) Date of Patent: Jul. 30, 2013

(54) MECHANISM FOR INDICATION OF THE LUNAR PHASES

(75) Inventors: Johan Montet, Les Charbonnieres (CH); Fabrice Deschanel, Villers-le-lac (FR)

(73) Assignee: Societe anonyme de la Manufacture d'Horlogerie Audemars Piguet & Cie, Le Brassus (CH)

( * ) Notice: Subject to any disclaimer, the term of this patent is extended or adjusted under 35 U.S.C. 154(b) by 196 days.

(21) Appl. No.: 13/117,923

(22) Filed: May 27, 2011

(65) Prior Publication Data

US 2011/0292768 A1 Dec. 1, 2011

(30) Foreign Application Priority Data

Jun. 1, 2010 (CH) ..... 860/10

(51) Int. Cl.
*G04B 19/26* (2006.01)

(52) U.S. Cl.
USPC ..... 368/15; 368/16; 368/18

(58) Field of Classification Search
CPC ..... G04B 19/26
USPC ..... 368/15, 16, 17, 18
See application file for complete search history.

(56) References Cited

U.S. PATENT DOCUMENTS

| | | | | |
|---|---|---|---|---|
| 6,507,536 | B1 | 1/2003 | Keatch | |
| 2006/0221771 | A1 * | 10/2006 | Zimmermann et al. | 368/16 |
| 2009/0274010 | A1 * | 11/2009 | Vuilleumier et al. | 368/18 |

FOREIGN PATENT DOCUMENTS

| | | | |
|---|---|---|---|
| DE | 8610323 | U | 5/1986 |
| EP | 0230878 | A1 | 8/1987 |
| EP | 1615086 | A1 | 1/2006 |
| EP | 1708049 | A2 | 10/2006 |
| FR | 2863368 | A1 | 6/2005 |

* cited by examiner

*Primary Examiner* — Amy Cohen Johnson
*Assistant Examiner* — Matthew Powell
(74) *Attorney, Agent, or Firm* — Patterson Thuente Pedersen, P.A.

(57) ABSTRACT

A mechanism for indication of the lunar phases, in particular for a mechanical watch, including a moon disk and a dial having a substantially semi-circular aperture. The moon disk is rotated in such a way as to display the indications inscribed on the moon disk through the aperture in order to indicate the lunar phases. In addition, the mechanism comprises at least one first occultation disk housed rotatably, at least in part, between the moon disk and the dial, and a gear train which drives the at least first occultation disk in such a way that the indications inscribed on the moon disk are obscured, at least in part, during specific phases of operation of the mechanism in such a manner that the indications appearing through the aperture correspond substantially to the natural appearance of the moon during the entire lunation. The invention also relates to a watch piece comprising such an indication mechanism.

20 Claims, 5 Drawing Sheets

Fig. 1a
PRIOR ART
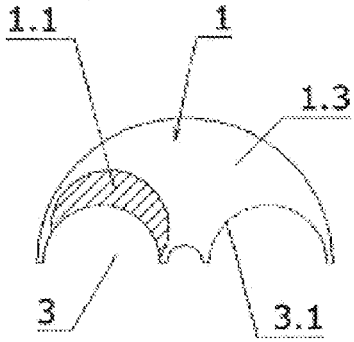
Fig.1b
PRIOR ART
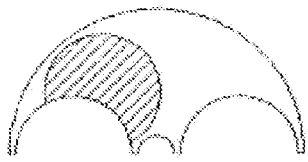
Fig. 1c
PRIOR ART
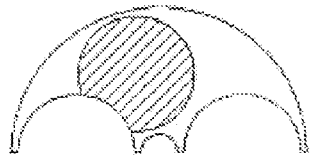
Fig. 2a
Fig. 2b
Fig. 2c
Fig. 2d
Fig. 2e
Fig. 2f
Fig. 2g
Fig. 2h
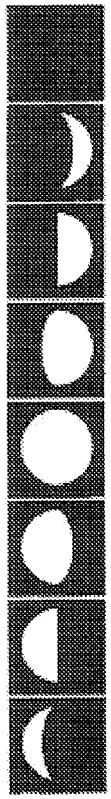

Fig. 3e
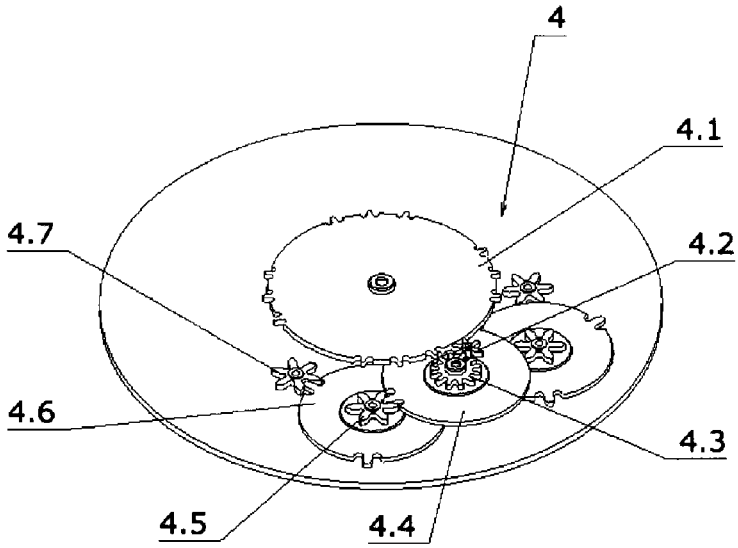
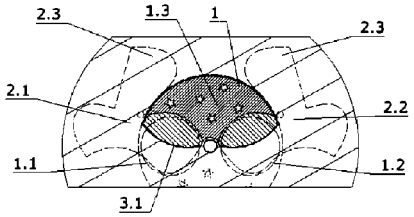
Fig. 4a
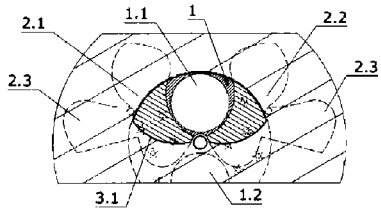
Fig. 4e
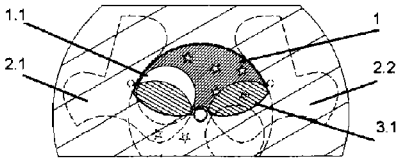
Fig. 4b
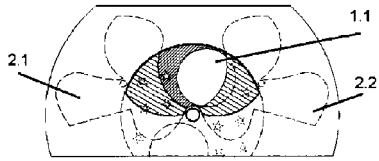
Fig. 4f
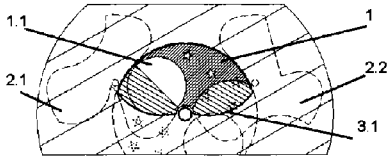
Fig. 4c
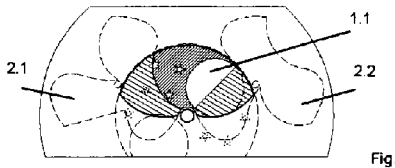
Fig. 4g
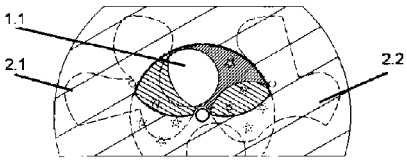
Fig. 4d
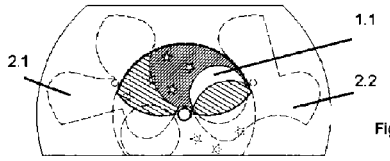
Fig. 4h

MECHANISM FOR INDICATION OF THE LUNAR PHASES

RELATED APPLICATION

The present application claims priority to CH application No. 00860/10 filed Jun. 1, 2010, which is incorporated herein in its entirety by reference.

FIELD OF THE INVENTION

The present invention relates to a mechanism for indication of the lunar phases, in particular for a mechanical watch, comprising a moon disk and a dial comprising a substantially semi-circular aperture, the moon disk being rotated in such a way as to display the indications inscribed on the moon disk through the aperture in order to indicate the lunar phases. The present invention also relates to a watch piece comprising such an indication mechanism.

BACKGROUND

Devices for indication of the lunar phases of the type mentioned above exist for quite some time and traditionally have a moon disk on which two circles, which are yellow or else generally clear and symbolise the moon, are drawn on a dark background, whereas said substantially semi-circular aperture in the dial comprises a base which is separated into two concave portions, the entire assembly being known to the person skilled in the art. When this type of moon disk rotates beneath the aperture, the different lunar phases are displayed symbolically. In particular, the new moon is represented by the dark background when none of the clear circles appears in the aperture, the waxing moon and waning moon are represented by a C-shaped portion of the clear circle which is thicker or thinner when one of the circles is visible but is hidden in part by one of said concave portions of the aperture, and the full moon is represented by one of the circles being fully visible through the aperture.

However, this representation does not correspond to the actual appearance of the lunar phases during the entire lunation. In particular, the fact that all the waxing and waning phases of the portion visible from earth of the illuminated surface of the moon are represented merely by one, generally concave symbol does not correspond to reality. In fact, the natural appearance of the lunar phases, i.e. the shape of the portion which is visible from earth of the surface of the moon illuminated by the sun, depends, by generalizing to some extent, on the geometric constellation between three points, more specifically the location of the observer on the earth, the position of the moon relative to the earth, and the position of the sun relative to the earth and the moon. Depending on this geometric constellation, the observer can see all, only some, or else none of the half of the surface of the moon which is illuminated by the sun, disregarding those specific cases in which the moon is positioned in the earth's shadow.

During the waxing and waning phases of the portion visible from earth of the illuminated surface of the moon, this visible portion may also be D-shaped, in particular during lunation phases known as the first quarter and the last quarter, and may adopt a convex shape during lunation phases known as the waxing or waning gibbous moon. This appearance of the lunar phases is therefore not taken into account by the conventional, above-mentioned devices for indication of the lunar phases. Apart from electronic devices which take into account in a more detailed manner the actual shape of the portion which is visible from earth of the illuminated surface of the moon, the prior art does not yet appear to contain, up to now, a mechanism which makes it possible, with the aid of relatively simple means, to represent more realistically the lunation within the meaning mentioned above.

SUMMARY OF THE INVENTION

In view of the currently known prior art, there is therefore the need to provide a mechanism for indication of the lunar phases for watch pieces which allows to display more realistically the portion visible from the earth of the surface of the moon illuminated by the sun whilst preserving a conventional display mode.

The object of the present invention is therefore to overcome the drawbacks of known devices for indication of the lunar phases and to achieve the above-mentioned advantages, in particular to make it possible to produce a mechanism for indication of the lunar phases for watch pieces of which the display of the lunar phases corresponds better to the situation seen in reality without excessively increasing the complexity, size or production cost of the mechanism.

To this end, the present invention proposes a mechanism for indication of the lunar phases of the type mentioned above, in particular for a mechanical watch piece, which mechanism is characterised by the features specified in claim 1, or else a corresponding watch piece. In particular, an indication mechanism according to the present invention comprises at least one first occultation disk housed rotatably, at least in part, between said moon disk and said dial, and a gear train which drives said at least first occultation disk in such a way that the indications inscribed on the moon disk are obscured, at least in part, during specific phases of operation of the mechanism so that the indications appearing through the aperture correspond substantially to the natural appearance of the moon during the entire lunation.

As a result of these measures a mechanism for indication of the lunar phases for watch pieces, in particular mechanical watches, is obtained which offers a display which corresponds more realistically to the actual appearance of the portion visible from earth of the surface of the moon illuminated by the sun, such realistic indication being provided during the entire lunation. Compared with the devices of the prior art, the mechanism according to the present invention has the advantage of representing, in particular, the lunar phases of the first and last quarters as well as the waxing and waning gibbous moon in a manner which corresponds more to reality than before.

Different embodiments of the mechanism for indication of the lunar phases according to the present invention make it possible to provide either one or more occultation disks which can also be housed concentrically or non-concentrically relative to the moon disk in accordance with the requirements regarding the display of the lunar phases and/or the technical design of the watch into which the mechanism is to be integrated. Similarly, the configuration of the one or more occultation disks themselves may vary depending on these parameters. Consequently, the mechanism may be provided in a number of embodiments and is therefore highly versatile.

Furthermore, the gear train which rotates said at least first occultation disk normally comprises a first program wheel which is fixed to the moon disk, a second program wheel and at least one third program wheel which are arranged, depending on the arrangement of the occultation disks in accordance with the above-mentioned embodiments, in such a way that these occultation disks are driven intermittently so as to release the view of the indications inscribed on the moon disk, or else to hide them in part depending on the lunar phase to be displayed. The mechanism can thus be produced whilst remaining technically relatively simple and economical in terms of its production.

Further features as well as the corresponding advantages will become clear from the dependent claims and from the more detailed description of the invention given hereinafter.

BRIEF DESCRIPTION OF THE DRAWINGS

The accompanying drawings schematically illustrate the prior art and also several exemplary embodiments of the invention.

FIGS. 1*a* to 1*c* schematically show the indication of the lunar phases by a conventional device of the prior art.

FIGS. 2*a* to 2*h* schematically illustrate the actual appearance of the portion which is visible from earth of the surface of the moon illuminated by the sun during a number of lunation phases.

FIGS. 3*c*, 3*d* and 3*e* show a plan view, a side view and a perspective view respectively of a first embodiment of an indication mechanism according to the present invention which utilises a moon disk and the occultation disks illustrated in FIGS. 3*a* and 3*b* respectively, with some parts being illustrated transparently in order to facilitate comprehension.

FIGS. 4*a* to 4*h* schematically illustrate the operation of the first embodiment of the indication mechanism according to the present invention by showing the indication displayed by the mechanism during eight different phases of lunation, with some parts being illustrated transparently in order to facilitate comprehension.

Figure 3A:
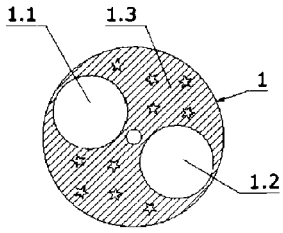
FIG. 3*a* is a plan view of an embodiment of a moon disk according to the present invention.
Figure 3B:
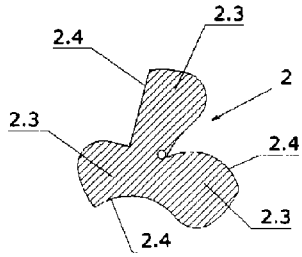
FIG. 3*b* is a plan view of an embodiment of an occultation disk according to the present invention.

The invention will now be described in detail with reference to the accompanying drawings which illustrate, by way of example, a number of embodiments of the invention.

DETAILED DESCRIPTION

In order to better illustrate the drawbacks of the devices of the prior art, reference is first made to FIGS. 1*a* to 1*c* and 2*a* to 2*h*. As mentioned in the introduction, the conventional devices for indication of the lunar phases often comprise a moon disk 1 on which two circles 1.1, 1.2, which are clear and symbolise the moon, are inscribed on a dark background 1.3 symbolising the sky, whereas a dial 3 comprises a substantially semi-circular aperture 3.1 with a base having two concave portions. During rotation of the moon disk 1 beneath the aperture 3.1, the different lunar phases are displayed symbolically, as illustrated schematically for three lunar phases in FIGS. 1*a*, 1*b* and 1*c*. In this type of device, the indication is generally always displayed with a concave shape, except for the new moon and the full moon.

As can be seen very clearly with reference to FIGS. 2*a* to 2*h*, which schematically show the eight primary different silhouettes of lunation, more specifically in the order of the new moon, first crescent, first quarter, waxing gibbous moon, full moon, waning gibbous moon, last quarter and last crescent, this representation however does not correspond to the actual appearance of the lunar phases during the entire lunation. In particular, the conventional devices for indication of the lunar phases as illustrated in FIGS. 1 *a* to 1*c* can illustrate, somewhat realistically, the four typical silhouettes of the moon according to FIGS. 2*a* (new moon), 2*b* (first crescent), 2*e* (full moon) and 2*h* (last crescent). However, they cannot display realistically the other four typical silhouettes of the moon, that is to say the lunar phases illustrated schematically in FIGS. 2*c* (first quarter), 2*d* (waxing gibbous moon), 2*f* (waning gibbous moon) and 2*g* (last quarter). As already mentioned in the introduction, the reason for this lies in the fact that, in the conventional devices, all the waxing and waning phases of the portion which is visible from earth of the illuminated surface of the moon are represented merely by a generally concave symbol. This does not correspond with reality since, during the waxing and waning phases of this portion which is visible from earth, this portion may be concave, D-shaped with a substantially straight edge, and convex (see FIGS. 2*a* to 2*h*). The prior art does not yet appear to contain a mechanism which makes it possible, with the aid of relatively simple means, to illustrate more realistically all the lunar phases.

A mechanism for indication of the lunar phases according to the present invention is intended to overcome these drawbacks and to make it possible to display, realistically, the portion which is visible from earth of the surface of the moon illuminated by the sun during the entire lunation. As illustrated schematically in FIGS. 3*a* to 3*e* and 4*a* to 4*h*, the mechanism therefore comprises, in principle, the parts of a conventional device, that is to say a moon disk 1 and a dial 3 comprising, in accordance with a first embodiment, a substantially semi-circular aperture 3.1, possibly but not necessarily with a base which is separated into two concave portions. Similarly, the moon disk 1 may comprise two or more clear circles 1.1, 1.2 or any other such inscription which makes it possible to show the moon on a dark background 1.3 illustrating the sky, such as the moon disk 1 in its preferred variant shown in FIG. 3*a*. It is rotated so as to display the indications 1.1, 1.2 inscribed on the moon disk 1 through the aperture 3.1 so as to indicate the lunar phases. Given that the mechanism is intended to be integrated into a watch piece, in particular a mechanical watch, the moon disk 1 is normally driven by the basic movement known to the person skilled in the art, usually at a rate of one step per day, in such a way that it carries out, for example if it comprises two inscriptions 1.1, 1.2, a rotation of 180° per lunation period, in other words two lunations per each cycle of rotation. It is clear that the person skilled in the art will be able to adapt this for other configurations of the moon disk, for example if it comprises three or more inscriptions.

As can be seen more specifically in FIGS. 3*b* to 3*e*, an indication mechanism according to the present invention generally differs from the devices of the prior art in that it comprises at least one occultation disk 2. This at least first occultation disk 2.1 is housed rotatably and is generally arranged at least in part between said moon disk 1 and said dial 3 so as to superpose the moon disk depending on its position. A gear train 4 allows to drive, via the moon disk 1, said at least first occultation disk 2.1 in such a way that the indications 1.1, 1.2 inscribed on the moon disk 1 are obscured, at least in part, during specific phases of operation of the mechanism, such that the indications 1.1, 1.2 appearing through the aperture 3.1 substantially correspond to the natural appearance of the moon during the entire lunation. Moreover, said at least first occultation disk 2.1 is configured, depending on its position in the mechanism and/or on the shape of the aperture 3.1 formed in the dial 3 or else on other parameters, so as to be provided with arms 2.3 and/or apertures 2.5 of a specific shape.

An indication mechanism of this type according to the present invention may be provided in a number of embodiments, of which some will be described in greater detail hereinafter in order to illustrate specifically and by way of example the general arrangement described in the paragraph above. In addition to a number of parameters and further details which may be varied, these embodiments of the mechanism are characterised in particular, on the one hand, with regard to the axis of rotation of said occultation disk(s) 2, which may be arranged concentrically or non-concentrically relative to the axis of rotation of the moon disk 1 and, on the other hand, with regard to the number of occultation disks 2, which may be one, two or more. The shape of the occultation disks 2 will be selected accordingly.

Figure 3C:
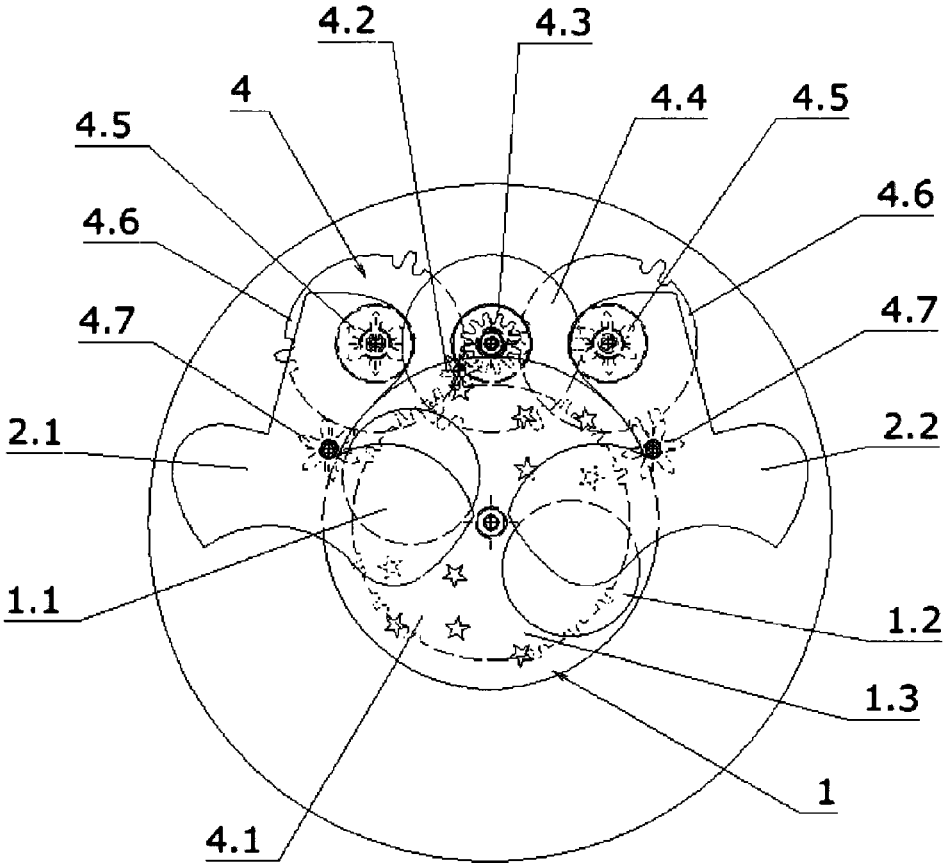

A first embodiment of a mechanism for indication of the lunar phases according to the present invention illustrated schematically in FIGS. 3*a* to 3*e* and 4*a* to 4*h* is an example of such a mechanism comprising two occultation disks 2.1, 2.2 which are arranged non-concentrically relative to the moon disk 1. This mechanism comprises, in particular, a first occultation disk 2.1 and a second occultation disk 2.2 which are housed substantially on either side of the moon disk 1, as can be seen in FIG. 3*c*. The axes of rotation of these occultation disks 2.1, 2.2 are close to the circumference of the moon disk 1 and substantially form, in this embodiment of the mechanism, an angle comprised in the range of approximately 90° to 180°, preferably of 120° to 140°, with the axis of the moon disk 1 as a function of the geometric arrangement and configuration of the different elements. Therefore, each occultation disk 2.1, 2.2 is sandwiched between the moon disk 1 and the substantially semi-circular aperture 3.1 and may, owing to its configuration and as a function of its angular position, obscure all or none or part of the indication 1.1, 1.2 inscribed on the moon disk 1 which is intended to be visible in a desired form through the aperture 3.1 formed in the dial 3.

To this end, said first 2.1 and second occultation disks 2.2 used in this embodiment of the mechanism each comprise at least two arms 2.3 which have, viewed in their direction of rotation, a convex and straight front portion 2.4 respectively. As shown schematically in FIG. 3*b*, each of these occultation disks 2.1, 2.2 preferably comprises three arms 2.3 having a convex, straight and concave front portion 2.4 respectively. In fact, as will also emerge clearly hereinafter within the scope of the description of other embodiments of the mechanism, the third arm comprising a concave front portion may be dispensed with if the aperture 3.1 of the dial 3 is not exactly semi-circular, but comprises a base having two concave portions which may adopt the function of said third arm of the relevant occultation disk 2. Furthermore, it will be noted in this embodiment that the two disks 2.1, 2.2 are preferably identical, but are mounted symmetrically relative to one another.

The gear train 4 which generally allows to drive said at least first occultation disk 2.1 will be described hereinafter in greater detail and by way of example in the context of the description of this first embodiment of the mechanism, but it is clear that the person skilled in the art will be able to adapt it, based on the present technical instruction, similarly for the other embodiments which will be described hereinafter. As shown schematically in FIGS. 3*c*, 3*d* and 3*e*, which show a plan view, a side view and a perspective view respectively of the first embodiment of an indication mechanism according to the present invention which utilises a moon disk 1 and occultation disks 2.1, 2.2 according to FIGS. 3*a* and 3*b* respectively, with some parts being shown transparently in FIG. 3*c* in order to facilitate comprehension, the gear train 4 comprises a first program wheel 4.1 which is mounted fixedly to the moon disk 1. Said moon disk being driven normally at a rate of one step per day by the basic movement, the first program wheel 4.1 carries out the same rotary movement and thus drives a second program wheel 4.4 via at least one intermediate pinion, in the present case via a first intermediate pinion 4.2 and a second intermediate pinion 4.3. The intermediate pinions make it possible, via the configuration of their toothings, to select the ratio of angular drive between the first 4.1 and second program wheel 4.4, and therefore to adapt the train depending on requirements, for example as a function of the configuration of the occultation disks 2. The toothing of the program wheel 4.4, this latter being mounted fixedly to the second intermediate pinion 4.3 in the example shown in the figures, can mesh with at least one program pinion 4.5 of a third program wheel 4.6. In the case of the gear train 4 of the first embodiment of an indication mechanism shown in FIGS. 3*c* to 3*e*, the second program wheel 4.4 can mesh with two program pinions 4.5, each carrying a third program wheel 4.6, which are housed rotatably on either side of the second program wheel 4.4. Each of these third program wheels 4.6, similarly to the other wheels if desired, can be locked against any involuntary rotation, for example with the aid of corresponding locking springs which are well known to the person skilled in the art, and can, with the aid of its toothing and if driven in turn by the second program wheel 4.4, drive an occultation pinion 4.7 which carries an occultation disk 2.1, 2.2.

Figure 3D:
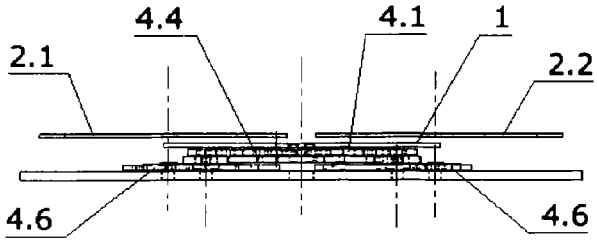

More specifically, in the case of the gear train 4 of the first embodiment of an indication mechanism shown in FIGS. 3*c* to 3*e* and for a moon disk 1 which carries out two lunations per cycle of rotation and thus comprises two indications 1.1, 1.2 inscribed on its upper surface representing the moon, the first program wheel 4.1 of a corresponding gear train 4 can, for example, comprise 12 teeth distributed over four identical sectors having three teeth each and separated by four untoothed sectors along its circumference. In the present case, three of the untoothed sectors are identical, whereas the fourth untoothed sector is slightly shorter. In this case the second program wheel 4.4 comprises three teeth which are distributed non-homogeneously over its circumference and are separated by three untoothed sectors, of which two are identical, as can be seen in particular in FIG. 3*c*. The third program wheel 4.6 comprises three teeth which are distributed homogeneously over its circumference and are separated by three identical untoothed sectors.

It is therefore easy to understand the operation of this embodiment of the mechanism with the aid of FIGS. 3*c* to 3*e* and 4*a* to 4*h*. The first program wheel 4.1, driven by the basic movement like the moon disk 1, causes with each tooth passing the rotation of the intermediate pinions 4.2, 4.3 and thus of the second program wheel 4.4. This second program wheel, having three teeth distributed non-homogeneously over its circumference, first drives three times in a row, intermittently and via the corresponding program pinion 4.5, the third program wheel 4.6 which is disposed on one side of the second program wheel 4.4 and then drives, similarly, three times in a row the third program wheel 4.6 which is disposed on the other side of the second program wheel 4.4. The second program wheel 4.4 thus carries out one revolution during one lunation; the third program wheel 4.6, which is not driven, remains stationary owing to its immobilisation mentioned above. Each time one of the two third program wheels 4.6 is driven intermittently via the second 4.4 and first program wheel 4.1, that is to say for each tooth of the second program wheel 4.4, the third program wheel 4.6, which finds itself activated in the kinematic chain evidently drives the corresponding occultation pinion 4.7 in such a way that either the first occultation disk 2.1 or the second occultation disk 2.2 rotates through 120°.

Thanks to the above-mentioned configuration of the occultation disks 2.1, 2.2, the operation described above of said first embodiment of the mechanism thus produces a sequence of silhouettes of the moon, as shown schematically in FIGS. 4*a* to 4*h*. In fact, if the new moon is taken as the starting point, the moon disk 1 of the mechanism according to the present invention is located, during this phase, in a position in which none of its inscriptions can be seen through the aperture 3.1 in the dial 3 (see FIG. 4*a*). The two occultation disks 2.1, 2.2 are each thus located, if they have three arms 2.3 as illustrated in FIGS. 4*a* to 4*h*, in an angular position in which the arm 2.3 having a concave front portion obscures the moon disk 1 and thus completes the shape of the aperture 3.1. To this end the upper surface of the occultation disks 2.1, 2.2 is evidently arranged similarly to the surface of the dial 3 around the aperture 3.1. In this case, the aperture 3.1 may be strictly semi-circular in shape. Alternatively and as already mentioned, the aperture 3.1 may also be substantially semi-circular but with two concave portions on its base, in such a way that the occultation disks 2.1, 2.2 can, in this case and if desired, have only two arms with a convex and straight portion respectively. As the moon disk 1 advances each day, one of the inscriptions 1.1, 1.2 on the moon disk 1 appears in part in a C-shaped manner below the first occultation disk 2.1 so as to display the first crescent of the moon, as shown schematically in FIG. 4*b*. At the time of the first quarter the gear train 4 described above rotates, in this case in a clockwise direction, the first occultation disk 2.1 through 120° so that its arm 2.3 comprising a straight front portion obscures, in part, the one of the inscriptions 1.1, 1.2 of the moon disk 1 which appears through the aperture 3.1, see FIG. 4*c*. Shortly thereafter, the gear train 4 again rotates the first occultation disk 2.1 through 120° so that its arm 2.3 comprising a convex front portion obscures, in part, the one of the inscriptions 1.1, 1.2 of the moon disk 1 which appears through the aperture 3.1, see FIG. 4*d*, in such a way that the mechanism displays realistically the waxing gibbous moon. The first occultation disk 2.1 then remains stationary and the gear train 4 rotates the second occultation disk 2.2 three times in a row, as shown in FIGS. 4*e*, 4*f*, 4*g* and 4*h*. The second occultation disk 2.2 thus ensures that, during this phase of operation of the mechanism, the one of the arms 2.3 having a convex, straight or concave front part obscures, in part, the one of the inscriptions 1.1, 1.2 of the moon disk 1 which appears through the aperture 3.1 in order to display the full moon, the waning gibbous moon, the last quarter and the last crescent. Lastly, the second occultation disk 2.2 again remains stationary and the cycle recommences by the rotation of the first occultation disk 2.1 into its position in which its concave front portion obscures the moon disk 1. As is clear from the description above, the ideal moment for rotation of the occultation disks 2.1, 2.2 may advantageously be selected by placing the teeth correspondingly on the circumference of the second program wheel 4.4, with their angle of rotation being selected by the configuration of the third program wheel(s) 4.6, which makes it possible to adapt the mechanism in a simple manner for other embodiments.

Figure 5A:
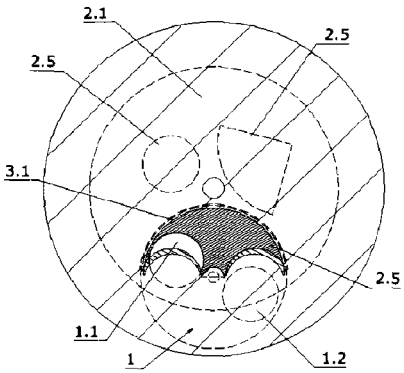
FIGS. 5*a*, 5*b* and 5*c* are plan views of a second embodiment of the indication mechanism according to the present invention, with some parts being illustrated transparently in order to facilitate comprehension, and schematically illustrate its operation by showing the indication displayed by the mechanism during three different phases of lunation.
Figure 5B:
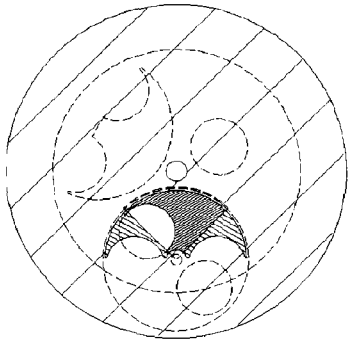
Figure 5C:
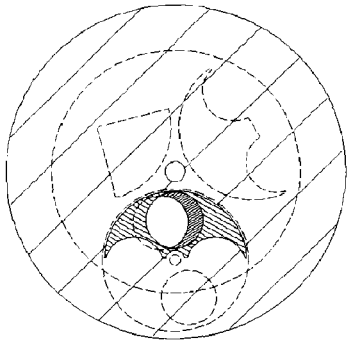
Figure 5D:
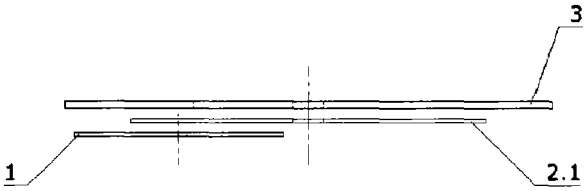
FIG. 5*d* is a side view of said second embodiment of the mechanism for indication of the lunar phases.
Figure 5E:
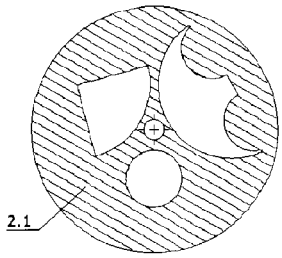
FIG. 5*e* is a plan view of an occultation disk according to the second embodiment of the present invention.

A second embodiment of an indication mechanism according to the present invention is illustrated schematically by plan views and a side view, in FIGS. 5*a* to 5*e*, with some parts being illustrated transparently in FIGS. 5*a* to 5*c* in order to facilitate comprehension, and represents an example of a mechanism of this type which comprises only one occultation disk 2.1. In this embodiment the occultation disk 2.1 is also positioned non-concentrically relative to the moon disk 1. In fact, the first and only occultation disk 2.1 is, in this case, housed on one side of the moon disk 1 and comprises at least two apertures 2.5, which are respectively internally circular and substantially triangular with its edge orientated toward the axis of the disk being of circular shape. As shown in FIGS. 5*a* to 5*c* and 5*e*, this occultation disk 2.1 preferably comprises three apertures 2.5 which are respectively internally circular, substantially triangular with its central edge being circular and substantially semi-circular with a base which is separated into two concave portions. In the latter case the aperture 3.1 in the dial 3 may be effectively semi-circular since it is not used to obscure the inscriptions 1.1, 1.2 intended to be displayed through this aperture 3.1, this role being fulfilled completely by the apertures 2.5 formed in the occultation disk 2.1. In the former case of only two apertures 2.5, which are internally circular and substantially triangular respectively, in the occultation disk 2.1, the aperture 3.1 formed in the dial 3 is preferably semi-circular, but has two concave portions in its base. These two concave portions are thus used to obscure the inscriptions 1.1, 1.2 on the moon disk 1 during specific phases of operation of the mechanism, in particular in order to display the first crescent and the last crescent of the moon. With regard to the gear train 4 for this embodiment of the indication mechanism, it is clear to the person skilled in the art that he will need only a single third program wheel, the toothing of which will be correspondingly adapted so as to ensure driving of the occultation disk 2.1 at the desired moment in order to obtain, similarly to the first embodiment of the mechanism, a suitable masking of the moon disk as a function of the lunar phase to be displayed. Likewise, the person skilled in the art will be able, based on the present technical instruction, to correspondingly modify the other parts of the gear train 4 in order to ensure this result, given that said second embodiment is elsewhere arranged in a manner completely analogous to the first embodiment of the mechanism. In addition, it is clear that the gear train 4 can also be adapted if the moon disk 1 is arranged differently, for example by being arranged in order to carry out three or more lunations per cycle of rotation, which is also within the capability of the person skilled in the art based on the present description. This second embodiment of a mechanism for indication of the lunar phases according to the present invention thus also makes it possible to display realistically all eight different and primary phases of lunation, as shown schematically and by way of example in FIGS. 5*a*, 5*b* and 5*c*. The side view of FIG. 5*d* shows the superposition of the three levels formed by the moon disk 1, the occultation disk 2.1 and the dial 3.

Figure 6A:
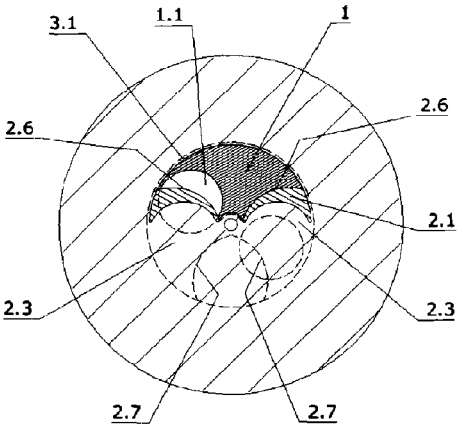
FIGS. 6*a* and 6*b* are plan views of a third embodiment of the indication mechanism according to the present invention, with some parts being illustrated transparently in order to facilitate comprehension, and schematically illustrate its operation by showing the indication displayed by the mechanism during two different phases of lunation.
Figure 6B:
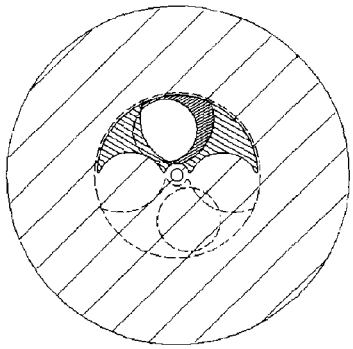
Figure 6C:
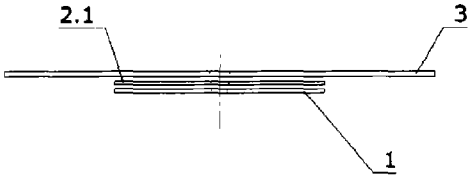
FIG. 6*c* is a side view of said third embodiment of the mechanism for indication of the lunar phases.
Figure 6D:
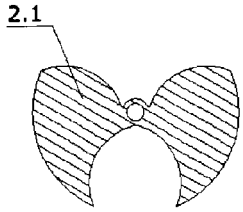
FIG. 6*d* is a plan view of an occultation disk according to the third embodiment of the present invention.

FIGS. 6*a* to 6*d* are plan and side views, with some parts being illustrated transparently in FIGS. 6*a* and 6*b* in order to facilitate comprehension, of a third embodiment of an indication mechanism according to the present invention which forms an example of a mechanism in which said at least first occultation disk 2.1, 2.2 is arranged concentrically relative to the moon disk 1. In addition, in this third embodiment the mechanism comprises only a single occultation disk 2.1. In this case, and as can be seen for example in FIGS. 6*a* and 6*b* as well as in FIG. 6*d*, said first occultation disk 2.1 comprises at least two arms 2.3 which each have, on one side and orientated towards one another, a first concave portion 2.6, and on the other side and orientated towards one another, a second convex portion 2.7. Of course, this disk 2.1 could also be formed with the aid of a disk comprising apertures of a corresponding shape instead of the arms. Consequently, the aperture 3.1 formed in the dial 3 is not used to obscure the inscriptions 1.1, 1.2 on the moon disk 1 intended to be displayed through this aperture, and may therefore be either strictly semi-circular in shape or have a base of a different shape. With regard to the gear train 4 for this embodiment of the indication mechanism, it is clear to the person skilled in the art that he will again need only one third program wheel which may, for example, be mounted fixedly to the rotational shaft of the occultation disk 2.1 and the toothing of which will thus be correspondingly adapted. The other portions of the gear train 4 can also be modified analogously by the person skilled in the art so as to obtain a suitable masking of the moon disk 1 as a function of the lunar phase to be displayed. Given that the occultation disk 2.1 in this embodiment does not comprise a straight portion, said third embodiment of a mechanism for indication of the lunar phases according to the present invention makes it possible to display realistically all the different and primary phases of lunation, except for the phases of the first and last quarters. Again, the principle of operation and the result in terms of the display obtained are illustrated schematically and by way of example in FIGS. 6*a* and 6*b*, whilst FIG. 6*c* shows the superposition of the three levels formed by the moon disk 1, the occultation disk 2.1 and the dial 3.

Figure 7A:
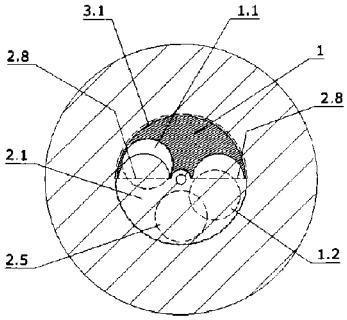
FIGS. 7*a*, 7*b* and 7*c* are plan views of a fourth embodiment of the indication mechanism according to the present invention, with some parts being illustrated transparently in order to facilitate comprehension, and schematically illustrate its operation by showing the indication displayed by the mechanism during three different phases of lunation.
Figure 7B:
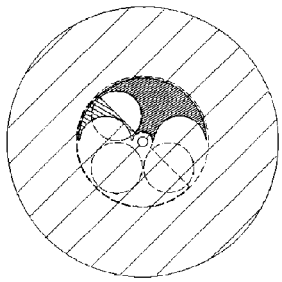
Figure 7C:
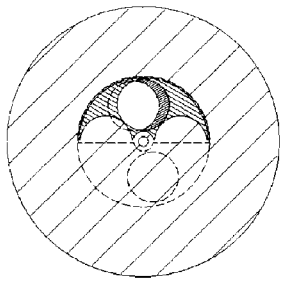
Figure 7D:
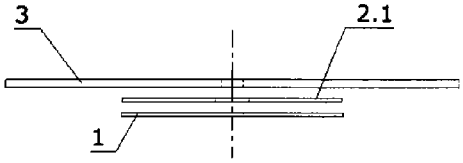
FIG. 7*d* is a side view of said fourth embodiment of the mechanism for indication of the lunar phases.
Figure 7E:
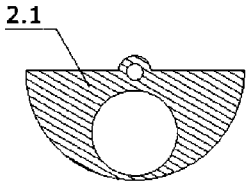
FIG. 7*e* is a plan view of an occultation disk according to the fourth embodiment of the present invention.

FIGS. 7*a* to 7*e* are plan and side views, with some parts being illustrated transparently in FIGS. 7*a* to 7*c* in order to facilitate comprehension, of a fourth embodiment of an indication mechanism according to the present invention which forms a further example of a mechanism in which said at least first occultation disk 2.1, 2.2 is arranged concentrically relative to the moon disk 1. As in the embodiment described above, in this fourth embodiment the mechanism comprises only a single occultation disk 2.1. In this case, and as can be seen for example in FIGS. 7*a*, 7*b* and 7*c* as well as in FIG. 7*e*, said first occultation disk 2.1 is, on the whole, substantially semi-circular and comprises at least two third straight portions 2.8 disposed over the linear edge of the occultation disk 2.1, and a substantially circular aperture 2.5 disposed towards the centre of the semi-circular shape of the occultation disk 2.1. In this embodiment of the mechanism the substantially semi-circular aperture 3.1 formed in the dial 3 of the mechanism preferably has a base which is separated into two concave portions so as to allow it to be used to obscure, during specific phases of operation of the mechanism, the inscriptions 1.1, 1.2 on the moon disk 1 which are intended to be displayed through this aperture. With regard to the gear train 4 of this embodiment of the indication mechanism, the person skilled in the art will be able to adapt the toothing of the single third program wheel necessary in this case based on the present technical instruction. Likewise, the other portions of the gear train 4 can be modified analogously by the person skilled in the art so as to obtain a suitable masking of the moon disk 1 as a function of the lunar phase to be displayed. Given that, in this embodiment of the mechanism, the occultation disk 2.1 comprises convex and straight portions whereas the aperture 3.1 formed in the dial 3 has a concave portion, this fourth embodiment of a mechanism for indication of the lunar phases according to the present invention allows to display realistically all the different and primary phases of lunation. FIGS. 7*a*, 7*b* and 7*c* illustrate schematically and by way of example the operation and the result in terms of the display obtained with this mechanism, whereas FIG. 7*d* shows the superposition of the three levels formed by the moon disk 1, the occultation disk 2.1 and the dial 3.

Figure 8A:
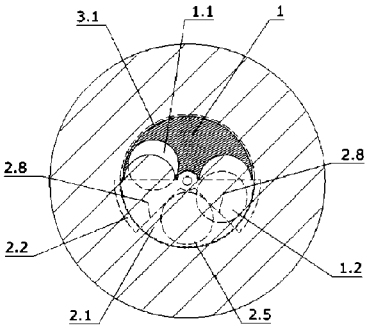
FIGS. 8*a*, 8*b* and 8*c* are plan views of a fifth embodiment of the indication mechanism according to the present invention, with some parts being illustrated transparently in order to facilitate comprehension, and schematically illustrate its operation by showing the indication displayed by the mechanism during three different phases of lunation.
Figure 8B:
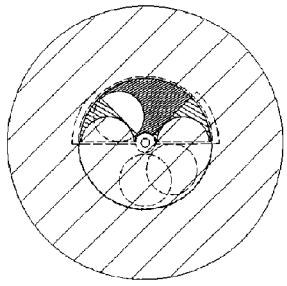
Figure 8C:
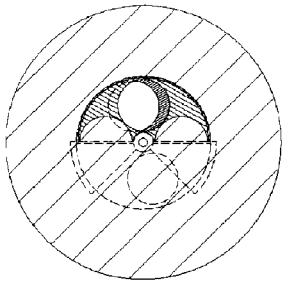
Figure 8D:
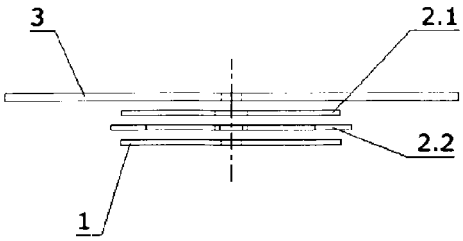
FIG. 8*d* is a side view of said fifth embodiment of the mechanism for indication of the lunar phases.
Figure 8E:
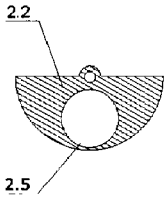
FIGS. 8*e* and 8*f* are plan views of the occultation disks according to the fifth embodiment of the present invention.
Figure 8F:
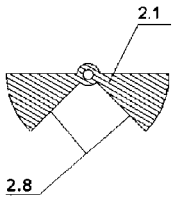

FIGS. 8*a* to 8*f* are plan and side views, with some parts being illustrated transparently in FIGS. 8*a* to 8*c* in order to facilitate comprehension, of a fifth embodiment of an indication mechanism according to the present invention which forms yet a further example of a mechanism in which said at least first occultation disk 2.1, 2.2 is arranged concentrically relative to the moon disk 1. In contrast with the embodiment described above, this mechanism comprises a first occultation disk 2.1 and a second occultation disk 2.2 which are housed rotatably and coaxially one on top of the other, forming two levels of occultation disks between the moon disk 1 and the aperture 3.1 formed in the dial 3. In this embodiment, and as can be seen for example in FIGS. 8*a*, 8*b* and 8*c*, said first occultation disk 2.1 comprises at least two straight third portions 2.8, preferably orientated towards one another. As can be seen for example in FIGS. 8*b* and 8*f*, this first occultation disk 2.1 may be, on the whole, substantially semi-circular and may comprise a substantially triangular aperture of which the two radial sides form said straight third portions 2.8. The second occultation disk 2.2 may also be, on the whole, substantially semi-circular and comprises a substantially circular aperture 2.5 which is disposed towards the centre of the semi-circular occultation disk 2.2, as illustrated schematically in FIG. 8*e*. It is not important to define which of the two occultation disks 2.1, 2.2 is arranged on top of the other. Again, the substantially semi-circular aperture 3.1 formed in the dial 3 of the mechanism preferably has a base which is separated into two concave portions so as to allow it to be used to obscure in part or completely, during specific phases of operation of the mechanism, the inscriptions 1.1, 1.2 on the moon disk 1 which are intended to be displayed through this aperture 3.1. Alternatively, this base which is separated into two concave portions could also be placed on one of the disks 2.1, 2.1. With regard to the gear train 4 of this embodiment of the indication mechanism, the person skilled in the art will be able to adapt the toothing of the two third program wheels necessary in this case based on the present technical instruction. Likewise, the other portions of the gear train 4 can be modified analogously by the person skilled in the art so as to obtain a suitable occultation of the moon disk 1 as a function of the lunar phase to be displayed. Given that, in this fifth embodiment of the mechanism, the first 2.1 and second occultation disks 2.2 comprise convex and straight portions whereas the aperture 3.1 formed in the dial 3 has a concave portion, this fifth embodiment of a mechanism for indication of the lunar phases according to the present invention also allows to display realistically all the different and primary phases of lunation. FIGS. 8*a*, 8*b* and 8*c* illustrate schematically and by way of example the operation and the result in terms of the display obtained with this mechanism, whereas FIG. 8*d* shows the superposition of the four levels formed by the moon disk 1, the first occultation disk 2.1, the second occultation disk 2.2 and the dial 3.

It remains to be noted that, of course, other equivalent embodiments, not illustrated in the figures, of a mechanism for indication of the lunar phases according to the present invention can be envisaged, for example by varying the position of the occultation disk(s) 2.1, 2.1, in particular by adding yet a further level with the aid of a third occultation disk, by modifying the shape, configuration or direction of rotation of the occultation disk(s) 2.1, 2.2 and/or of the moon disk 1, by modifying the aperture 3.1 formed in the dial 3 so as to adapt the mechanism, for example, for the display of lunar phases for the southern hemisphere instead of displaying them for the northern hemisphere, as shown in the figures, or by modifying the gear train 4, in particular the toothing of the program wheels or the corresponding pinions, but without substantially changing the overall operation or the result in terms of display compared with that disclosed above. Although it is not possible to describe them all here in detail, all of these embodiments are in fact within the capability of the person skilled in the art having at his disposal the technical instruction according to the present description.

It is thus clear that an indication mechanism comprising the above-mentioned features according to the present invention affords the significant advantage of being able to display, realistically, all the different and primary phases of lunation, that is to say it is able to display, at any time, the portion which is visible from earth of the surface of the moon illuminated by the sun in a more realistic manner. In addition, a mechanism of this type is highly versatile owing to the fact that it can be provided in a number of variants depending on technical or aesthetic requirements. An indication mechanism according to the present invention can cooperate conventionally with the other parts of the watch piece in which it is intended to be integrated, in particular with the basic movement, in such a way that the mechanism can easily be integrated into existing watch pieces without too much adjustment or significant redesigning of these pieces being necessary. Furthermore, these advantages are obtained without excessively increasing the complexity, size or production cost of the mechanism. Lastly, the mechanism according to the present invention is ideally adapted to be displayed visually on the dial of the watch piece, thus contributing significantly to the aesthetic appearance of such a watch piece.

Based on the detailed description given above, it is clear that the present invention also encompasses a watch piece, in particular a mechanical watch, which comprises a mechanism for indication of the lunar phases according to one of its embodiments, said moon disk 1 normally being driven at a rate of one step per day by the basic movement of said watch piece.

The invention claimed is:

1. A mechanism for indication of the lunar phases, in particular for a mechanical watch, comprising a moon disk and a dial comprising a substantially semi-circular aperture, the moon disk being rotated in such a way as to display the indications inscribed on the moon disk through the aperture in order to indicate the lunar phases, wherein the mechanism comprises at least one first occultation disk housed rotatably, at least in part, between said moon disk and said dial, and a gear train which drives said at least first occultation disk in such a way that the indications inscribed on the moon disk are obscured, at least in part, during specific phases of operation of the mechanism in such a manner that the indications appearing through the aperture correspond substantially to the natural appearance of the moon during the entire lunation, wherein said at least first occultation disk is arranged non-concentrically relative to the moon disk.

2. The mechanism according to claim 1, wherein the mechanism comprises a first occultation disk and a second occultation disk which are housed substantially on either side of the moon disk.

3. The mechanism according to claim 2, wherein said first and second occultation disks each comprise at least two arms having a convex and straight front portion respectively, viewed in their direction of rotation.

4. The mechanism according to claim 1, wherein the mechanism only comprises one first occultation disk housed on one side of the moon disk and comprising at least two apertures, which are internally circular and substantially triangular respectively.

5. A mechanism for indication of the lunar phases, in particular for a mechanical watch, comprising a moon disk and a dial comprising a substantially semi-circular aperture, the moon disk being rotated in such a way as to display the indications inscribed on the moon disk through the aperture in order to indicate the lunar phases, wherein the mechanism comprises at least one first occultation disk housed rotatably, at least in part, between said moon disk and said dial, and a gear train which drives said at least first occultation disk in such a way that the indications inscribed on the moon disk are obscured, at least in part, during specific phases of operation of the mechanism in such a manner that the indications appearing through the aperture correspond substantially to the natural appearance of the moon during the entire lunation, wherein said at least first occultation disk is arranged concentrically relative to the moon disk, and wherein said first occultation disk comprises at least two arms each having, on one side and orientated towards one another, a first concave portion and, on an opposing side and orientated towards one another, a second convex portion.

6. A mechanism for indication of the lunar phases, in particular for a mechanical watch, comprising a moon disk and a dial comprising a substantially semi-circular aperture, the moon disk being rotated in such a way as to display the indications inscribed on the moon disk through the aperture in order to indicate the lunar phases, wherein the mechanism comprises at least one first occultation disk housed rotatably, at least in part, between said moon disk and said dial, and a gear train which drives said at least first occultation disk in such a way that the indications inscribed on the moon disk are obscured, at least in part, during specific phases of operation of the mechanism in such a manner that the indications appearing through the aperture correspond substantially to the natural appearance of the moon during the entire lunation, wherein said at least first occultation disk is arranged concentrically relative to the moon disk, and wherein said first occultation disk comprises at least two straight third portions and a substantially circular aperture.

7. A mechanism for indication of the lunar phases, in particular for a mechanical watch, comprising a moon disk and a dial comprising a substantially semi-circular aperture, the moon disk being rotated in such a way as to display the indications inscribed on the moon disk through the aperture in order to indicate the lunar phases, wherein the mechanism comprises at least one first occultation disk housed rotatably, at least in part, between said moon disk and said dial, and a gear train which drives said at least first occultation disk in such a way that the indications inscribed on the moon disk are obscured, at least in part, during specific phases of operation of the mechanism in such a manner that the indications appearing through the aperture correspond substantially to the natural appearance of the moon during the entire lunation, wherein said at least first occultation disk is arranged concentrically relative to the moon disk, wherein the mechanism comprises a first occultation disk and a second occultation disk which are housed rotatably one on top of the other, said first occultation disk comprising at least two straight third portions, the second occultation disk comprising a substantially circular aperture.

8. The mechanism according to claim 1, further comprising a gear train which drives said at least first occultation disk and a first program wheel which is mounted fixedly to the moon disk and drives, via at least one intermediate pinion, a second program wheel which meshes with at least one third program wheel, each driving an occultation pinion carrying an occultation disk.

9. The mechanism according to claim 8, wherein said gear train comprises two third program wheels which each drive an occultation pinion carrying an occultation disk.

10. The mechanism according to claim 9, wherein said first program wheel comprises 12 teeth distributed over four identical sectors which are separated by four untoothed sectors along a circumference thereof, wherein said second program wheel comprises three teeth distributed non-homogeneously over a circumference thereof and separated by three untoothed sectors, of which two are identical, and wherein said third program wheel comprises three teeth distributed homogeneously over its circumference and separated by three identical untoothed sectors.

11. The mechanism according to claim 1, wherein said moon disk comprises at least two indications inscribed on an upper surface thereof representing the moon.

12. The mechanism according to claim 1 , wherein said moon disk is driven at a Rate of one step per day by a basic movement of the mechanical watch.

13. The mechanism according to claim 12, including a mechanical bracelet operably coupled to said mechanical watch.

14. The mechanism according to claim 3, wherein said first and second occultation disks each comprise three arms having a convex front portion, a straight front portion and a concave front portion respectively.

15. The mechanism according to claim 4, wherein the moon disk presents three apertures which are internally circular, substantially triangular and substantially semi-circular with a base which is separated into two concave portions respectively.

16. The mechanism according to claim 4, wherein the substantially semi-circular aperture formed in the dial of the mechanism has a base which is separated into two concave portions.

17. The mechanism according to claim 7, wherein the at least two straight third portions are oriented towards one another.

18. The mechanism according to claim 7, wherein the substantially semi-circular aperture formed in the dial of the mechanism has a base which is separated into two concave portions.

19. The mechanism according to claim 1, wherein said gear train comprises two third program wheels which each drive an occultation pinion carrying an occultation disk.

20. The mechanism according to claim 6, wherein the substantially semi-circular aperture formed in the dial of the mechanism has a base which is separated into to concave portions.

* * * * *